US006965350B2

(12) United States Patent
Sugiyama et al.

(10) Patent No.: US 6,965,350 B2
(45) Date of Patent: Nov. 15, 2005

(54) FLAT-PLATE MULTIPLEX ANTENNA AND PORTABLE TERMINAL

(75) Inventors: Takahiro Sugiyama, Tokyo (JP); Shinichi Takaba, Tokyo (JP); Morihiko Ikegaya, Tokyo (JP); Shinichiro Suzuki, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 82 days.

(21) Appl. No.: 10/325,814

(22) Filed: Dec. 19, 2002

(65) Prior Publication Data

US 2003/0122722 A1 Jul. 3, 2003

(30) Foreign Application Priority Data

Dec. 20, 2001 (JP) ..... 2001-387967

(51) Int. Cl.[7] ..... H01Q 13/10
(52) U.S. Cl. ..... 343/767
(58) Field of Search ..... 343/767, 927, 343/930, 846, 700 MS, 711, 770, 823, 907, 908, 915

(56) References Cited

U.S. PATENT DOCUMENTS 6,133,879 A * 10/2000 Grangeat et al. .... 343/700 MS
6,172,656 B1 * 1/2001 Ohwada et al. ..... 343/895
6,225,958 B1 * 5/2001 Amano et al. ..... 343/767
6,304,219 B1 * 10/2001 Rothe ..... 343/700 MS
6,333,714 B1 * 12/2001 Takahashi ..... 343/700 MS
6,392,609 B2 * 5/2002 Nieminen ..... 343/767
6,498,586 B2 * 12/2002 Pankinaho ..... 343/700 MS

* cited by examiner

*Primary Examiner*—Don Wong
*Assistant Examiner*—Minh Dieu A
(74) *Attorney, Agent, or Firm*—James B. Conte; Barnes & Thornburg LLP

(57) ABSTRACT

A flat-plate multiplex antenna that is small in size, wide in band and possible to operate at least two frequency bands and a portable terminal using it are provided. A flat-plate multiplex antenna having at least two resonant frequencies, comprising a radiating conductor provided with a U shaped slit and open slit opening either end of said U shaped slit, and a feeder line which supplies power to said radiating conductor.

8 Claims, 9 Drawing Sheets

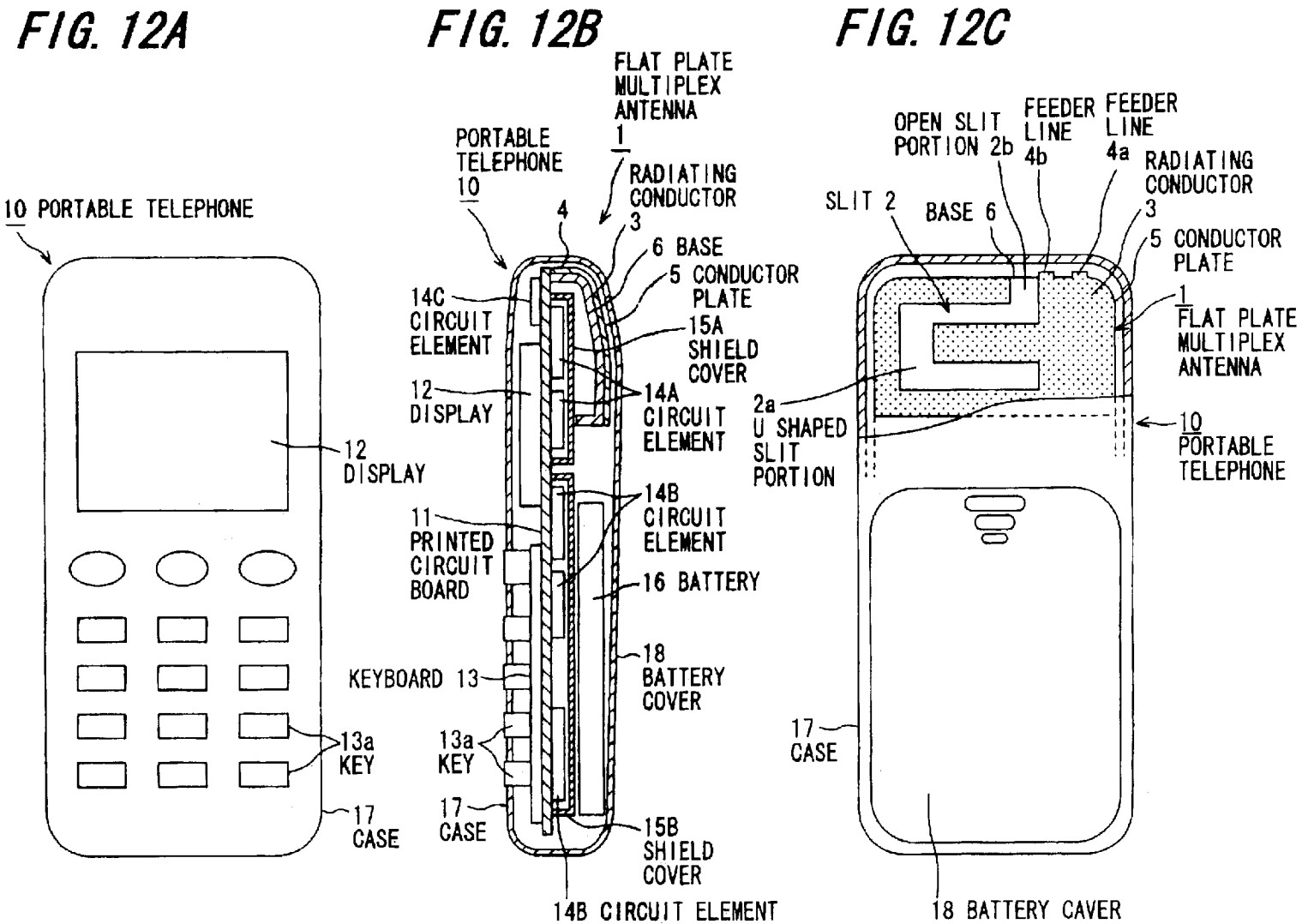
FIG. 12A
10 PORTABLE TELEPHONE
12 DISPLAY
13a KEY
17 CASE
FIG. 12B
PORTABLE TELEPHONE 10
FLAT PLATE MULTIPLEX ANTENNA 1
RADIATING CONDUCTOR 3
4
6 BASE
5 CONDUCTOR PLATE
15A SHIELD COVER
14A CIRCUIT ELEMENT
14B CIRCUIT ELEMENT
16 BATTERY
18 BATTERY COVER
15B SHIELD COVER
14B CIRCUIT ELEMENT
14C CIRCUIT ELEMENT
12 DISPLAY
11 PRINTED CIRCUIT BOARD
KEYBOARD 13
13a KEY
17 CASE
FIG. 12C
OPEN SLIT PORTION 2b
FEEDER LINE 4b
FEEDER LINE 4a
RADIATING CONDUCTOR 3
5 CONDUCTOR PLATE
1 FLAT PLATE MULTIPLEX ANTENNA
10 PORTABLE TELEPHONE
SLIT 2
BASE 6
2a U SHAPED SLIT PORTION
17 CASE
18 BATTERY CAVER

FLAT-PLATE MULTIPLEX ANTENNA AND PORTABLE TERMINAL

BACKGROUND OF THE INVENTION

1. Field of the invention

The present invention relates to a flat-plate multiplex antenna which operates at least two frequency bands, and a portable terminal such as a portable telephone (includes PHS), a mobile wireless device, a note type personal computer and so on, and more specifically, to a flat-plate multiplex antenna that is small in size, wide in band and possible to operate at least two frequency band and a portable terminal using it.

2. Prior Art

Recently, accompanied with high performance of communication, a portable terminal which is possible to operate at two frequency bands is used practically.

A conventional antenna for use in a portable terminal is shown in FIG. 1. This antenna 50 comprising a radiating conductor 52 provided with a slit 51 having a J shaped slit portion 51*a* and an open slit portion 51*b* of which one end is opened, and being uniform slit width, a dielectric 53 provided to whole reverse side of the radiating conductor 53, and a feeder line 54*a*, 54*b* which supplies power to the radiating conductor 52.

According to the conventional antenna, adjustment of band by widening a slit width is almost impossible, because when a slit width is widened, band extends but resonant point moves to high frequency, and resonant point is moved to low frequency by widening position. Accordingly, antenna characteristic was adjusted by varying slit length with slit width is constant. Therefore, extending of band was limited. On the other hand, it is possible to extend band by enlarging antenna size (volume), but it becomes difficult to comply with demand to compactness.

SUMMARY OF THE INVENTION

An object of the present invention is to provide a flat-plate multiplex antenna that is small in size, wide in band and possible to operate at least two frequency band and a portable terminal using it.

In accordance with this invention, there is provided a flat-plate multiplex antenna having at least two resonant frequencies comprising a radiating conductor provided with a slit having width corresponding to band and either end being opened, and a feeder line which supplies power to said radiating conductor.

In accordance with this invention, there is provided a flat-plate multiplex antenna having at least two resonant frequencies comprising a radiating conductor provided with a U shaped slit and open slit opening either end of said U shaped slit, and a feeder line which supplies power to said radiating conductor.

In accordance with this invention, there is provided a portable terminal in which a flat-plate multiplex antenna having at least two resonant frequencies is installed, wherein said flat-plate multiplex antenna comprising a radiating conductor provided with a slit having width corresponding to band and either end being opened, and a feeder line which supplies power to said radiating conductor.

In accordance with this invention, there is provided a portable terminal in which a flat-plate multiplex antenna having at least two resonant frequencies is installed, wherein said flat-plate multiplex antenna comprising a radiating conductor provided with a U shaped slit and open slit opening either end of said U shaped slit, and a feeder line which supplies power to said radiating conductor.

BRIEF DESCRIPTION OF THE DRAWINGS

The present invention will be explained in more detail in conjunction with appended drawings, wherein:

FIGS. 12A, FIG. 12B and FIG. 12C are showing an embodiment of the portable telephone of the present invention.

DESCRIPTION OF THE PREFERRED EMBODIMENTS

Preferred embodiments of the present invention will be explained in conjunction with accompanying drawings.

Figure 1:
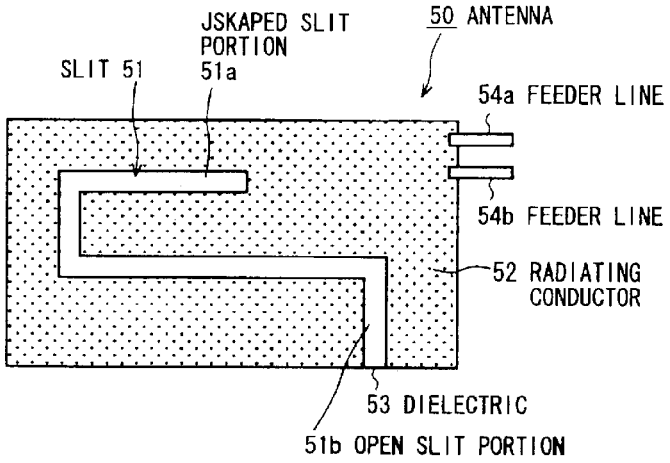
FIG. 1 PRIOR ART
FIG. 1 is an explanatory view showing a conventional antenna for use in a portable terminal.
Figure 2A:
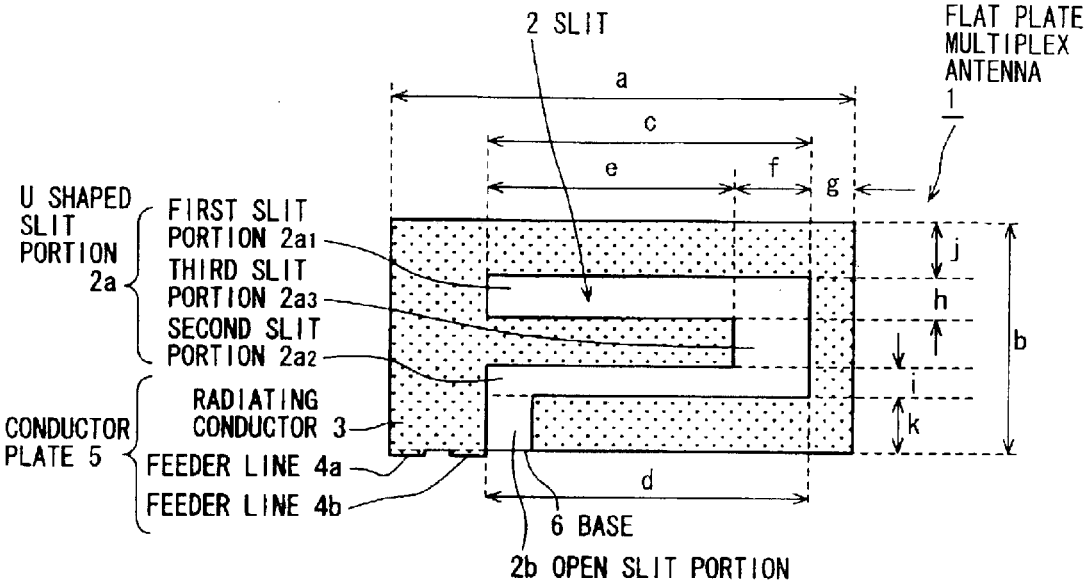
FIG. 2A is a plane view showing an embodiment of a flat-plate multiplex antenna of the present invention.
Figure 2B:
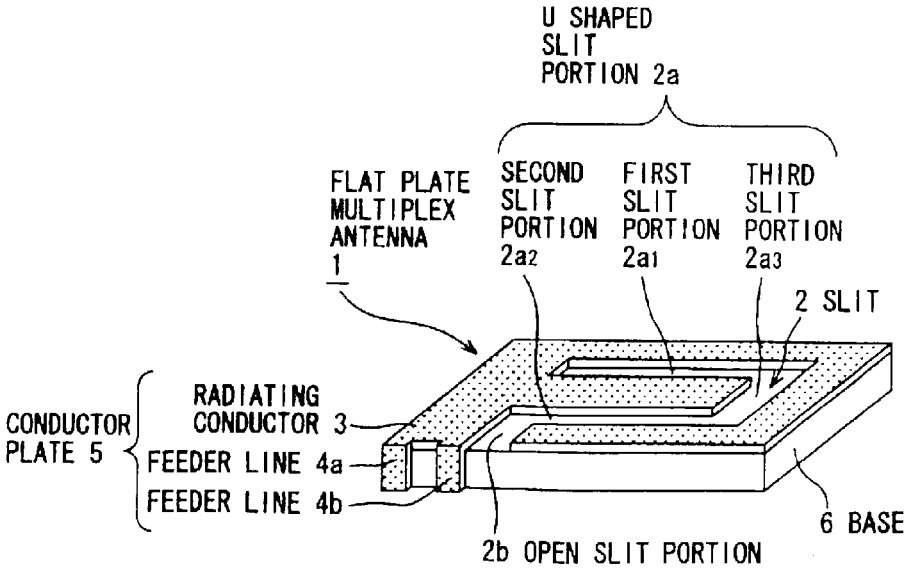
FIG. 2B is a perspective view showing an embodiment of a flat-plate multiplex antenna of the present invention.

FIG. 2A is a plane view showing an embodiment (first embodiment) of a flat-plate multiplex antenna of the present invention and FIG. 2B is a perspective view showing an embodiment of a flat-plate multiplex antenna of the present invention. The flat-plate multiplex antenna 1 comprising the conductor plate 5 and the base 6 which is holding the conductor plate 5. The conductor plate 5 comprising the flat radiating conductor 3 provided with the slit 2 of which one end is opened and having at least first resonant frequency $f_1$ and second resonant frequency $f_2$ ($f_1<f_2$), and a pair of feeder line 4*a*, 4*b* formed extending from the radiating conductor 3.

The slit 2 comprising, the U shaped slit potion 2*a* provided with a pair of the first slit portion $\mathbf{2}_{a1}$ and the second slit portion $2_{a2}$ paralleling each other and the third slit portion $2_{a3}$ between the first slit portion $2_{a1}$ and the second slit portion $2_{a2}$, and the open slit portion 2*b* opening one end of the U shaped slit potion 2*b*. In addition, the angles positioning at both sides of the third slit portion $2_{a3}$ of the U shaped slit potion 2*a* may be round, and the first slit portion $2_{a1}$, the second slit portion $2_{a2}$ and the third slit portion $2_{a3}$ may be curved. Further, the open slit portion 2*b* may be formed obliquely to the second slit portion $2_{a2}$, and may be curved.

Here, the length of the radiating conductor 3 is defined to be "a", the width of it to be "b", the length of the first slit portion $2_{a1}$ to be "c", the length of the second slit portion $2_{a2}$ to be "d", the width of the third slit portion $2_{a3}$ to be "f", (c−f) to be "e", the width of portion of the radiating conductor 3 positioning outside of the third slit portion $2_{a3}$ to be "g", the width of the first slit portion $2_{a1}$ to be "h", the width of the second slit portion $2_{a2}$ to be "i", the width of portion of the radiating conductor 3 positioning outside of the first slit portion $2_{a1}$ to be "j", and the width of portion of the radiating conductor 3 positioning outside of the second slit portion $2_{a2}$ to be "k". In addition, the radiating conductor 3 is formed to be planar in the figure, it may be formed to be curved or bended according to a shape of mounting device.

The either feeder line 4*a* in a pair of feeder line 4*a*, 4*b* is used as a power supply line, and the other feeder line 4*b* is used as a ground line. The power supply line and the ground line may be positioned reversely.

The conductor plate 5 is formed from copper, phosphor bronze or so on, and is plated by nickel, gold or so on so as to prevent corrosion. The conductor plate 5 is provided on the base 6 by adhesion, fitting, electroless plating or so on. In electroless plating, after plating by phosphor bronze or so on, plating by nickel, gold or so on is processed so as to prevent corrosion.

The base 6 is almost same size (a×b) as the radiating conductor 3, and having thickness corresponding to frequency band. Materials to form the base 6 is not limited so long as it can retain the shape of the conductor plate 5, but it is preferable to use dielectric material which is light weight, excellent heat resistance and small dielectric loss, for example acrylic butadiene styrene resin or acrylic butadiene styrene-polycarbonate resin may be used.

Figure 3A:
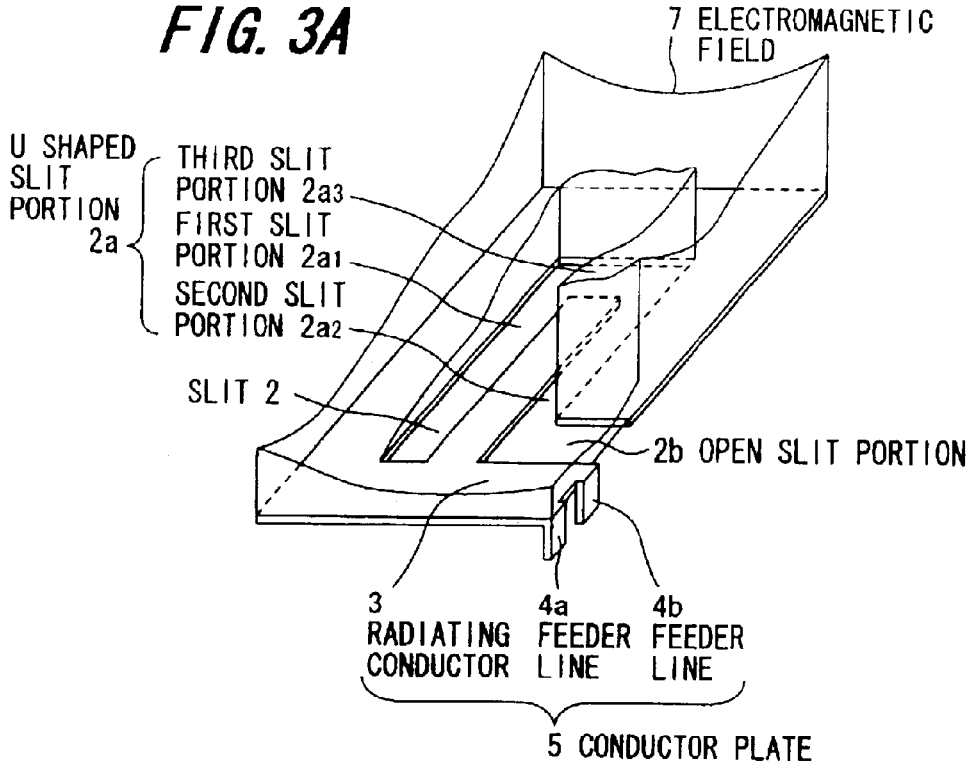
FIG. 3A is an explanatory view showing a simulation result of the first resonant frequency in the embodiment of the flat-plate multiplex antenna.
Figure 3B:
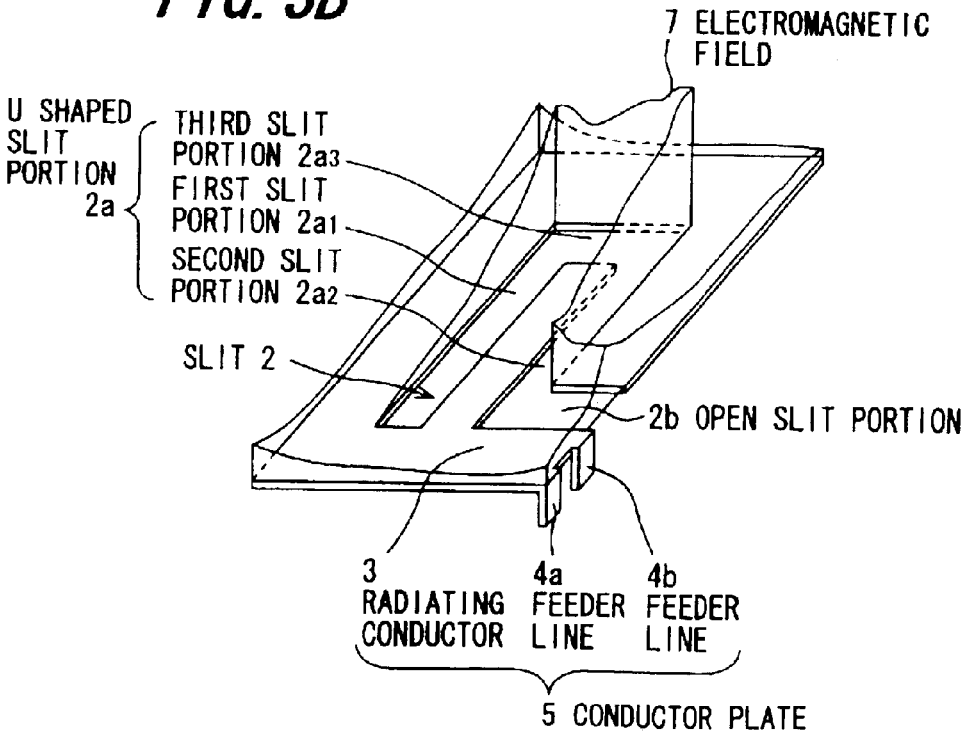
FIG. 3B is an explanatory view showing a simulation result of the second resonant frequency in the embodiment of the flat-plate multiplex antenna.

FIG. 3A and FIG. 3B are showing simulation results of the electromagnetic field in the above embodiment of the flat-plate multiplex antenna. FIG. 3A is a simulation result of the first resonant frequency, and FIG. 3B is a simulation result of the second resonant frequency. Since the electromagnetic field 7 of the first resonant frequency is showing large value at outer edge of the radiating conductor 3 as shown in FIG. 3A, the first resonant frequency is determined mainly that the length of outer edge of the radiating conductor 3, namely the length (c+b+d+2g) in FIG. 2A to be nearly odd number times of ¼ wavelength. Since the electromagnetic field 7 of the second resonant frequency is showing large value at outer edge of the slit 2 as shown in FIG. 3B, the second resonant frequency is determined mainly that the length of outer edge of the slit 2, namely the length (c+b+d−j−k) in FIG. 2A to be nearly integral number times of ½ wavelength. In addition, beside the foregoing, the first and second resonant frequency varies also with position of feeder line 4*a*, 4*b*, dielectric constant of the base 6 and so on.

Figure 4:
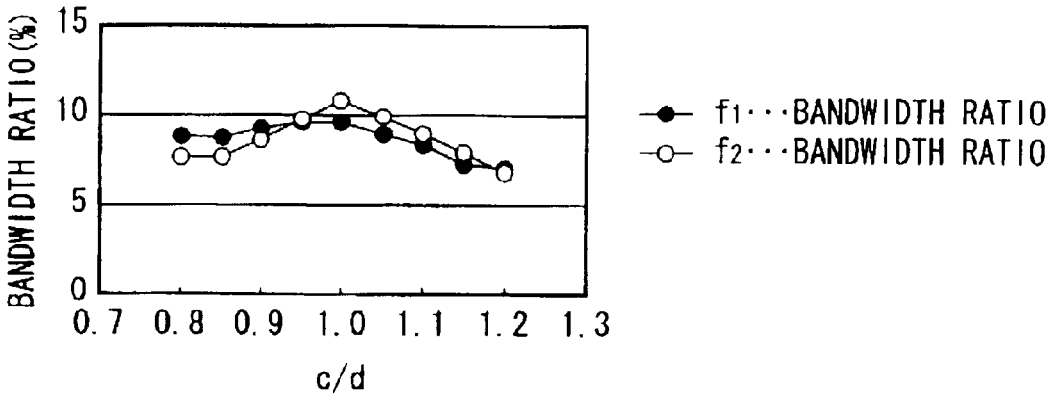
FIG. 4 is a graph showing a relation between the size ratio c/d and the band ratio.

FIG. 4 is showing a relation between the size ratio c/d and the bandwidth ratio. As apparent from the figure, the size ratio c/d is preferable to be 0.8–1.15 in which the band ratio can be obtained more than 7.5%, and more preferable to be 0.95–1.05 in which the band ratio can be obtained more than 9%. Specifically, when c=d, both the first resonant frequency $f_1$ and the second resonant frequency $f_2$ are showing highest value.

Figure 5:
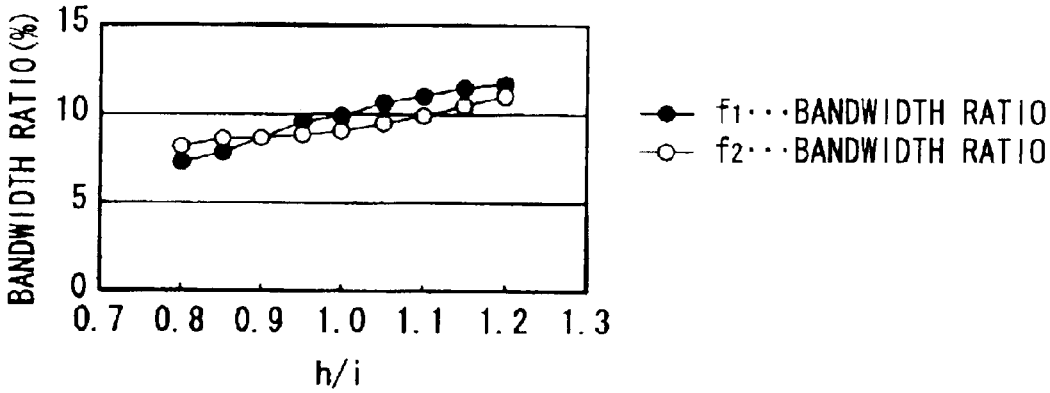
FIG. 5 is a graph showing a relation between the size ratio h/i and the band ratio.

FIG. 5 is showing a relation between the size ratio h/i and the bandwidth ratio. As apparent from the figure, the size ratio h/i is preferable to be 1.0–2.0 in which the band ratio can be obtained more than 9%. In the figure, the size ratio h/i is shown up to 1.2 by convenience of the measurement.

Figure 6:
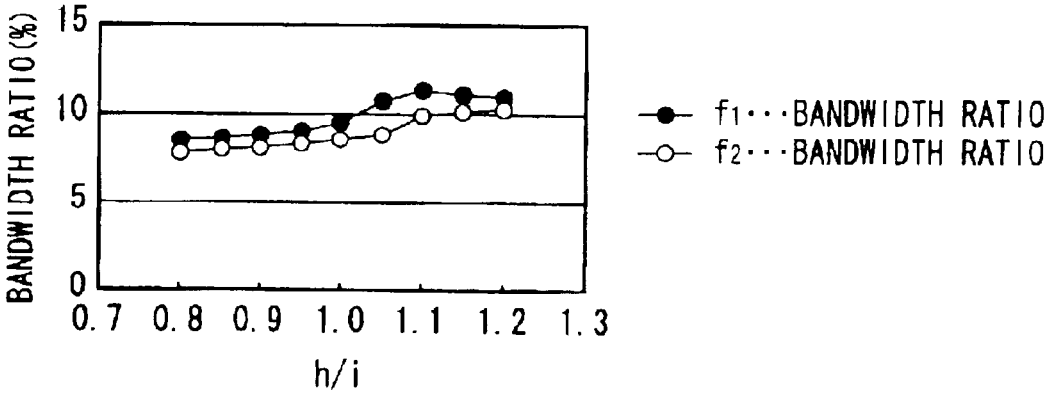
FIG. 6 is a graph showing a relation between the size ratio j/k and the band ratio.

FIG. 6 is showing a relation between the size ratio j/k and the bandwidth ratio. As apparent from the figure, the size ratio j/k is preferable to be 1.0–2.0 in which the band ratio can be obtained more than 9%. In the figure, the size ratio j/k is shown up to 1.2 by convenience of the measurement.

Figure 7:
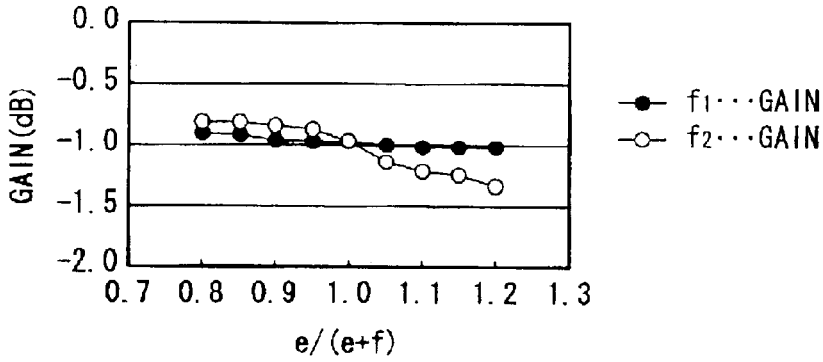
FIG. 7 is a graph showing a relation between the size ratio e/(e+f) and the gain.

FIG. 7 is showing a relation between the size ratio e/(e+f) and the gain. As apparent from the figure, the size ratio e/(e+f) is preferable to be 0.8–1.0 in which the gain can be obtained more than −1.0.

Figure 8:
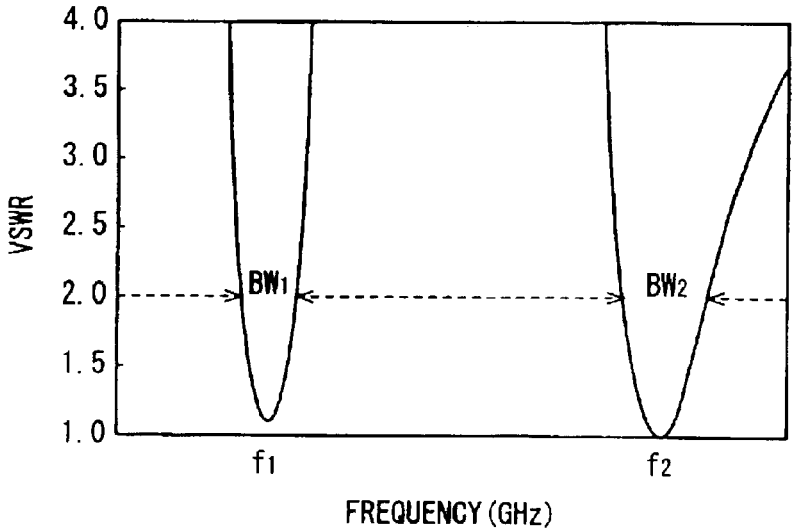
FIG. 8 is a graph showing a relation between VSWR and frequency.

FIG. 8 is showing a relation between VSWR (voltage standing wave ratio) and frequency. This VSWR is measured by setting the size of each potion of the radiating conductor 3 that thickness is 0.2 mm, a=40.0 mm, b=18.0 mm, c=23.0 mm, d=23.0 mm, e=18.5 mm, f=4.5 mm, g=3.0 mm, h=2.5 mm, i=1.5 mm, j=4.5 mm and k=4.0 mm. Then, each size ratio being c/d=1.0, h/i=1.67, j/k=1.125 and e/(e+f)=0.80.

The first resonant frequency f1 is obtained to be 920 MHz and the second resonant frequency $f_2$ is obtained to be 1795 MHz, and the bandwidth when VSWR is 2 is obtained that BW1=90 MHz for the first resonant frequency f1 and BW2=170 MHz for the second resonant frequency f2.

According to the first embodiment of the present invention, since width of each portion of the U shaped slit portion 2*a* and open slit portion 2*b* is corresponding to band, both the first and second resonant frequency are widened 1.2 times as conventional flat-plate antenna, and it is possible to improve communication quality and achieve small in size.

Figure 9A:
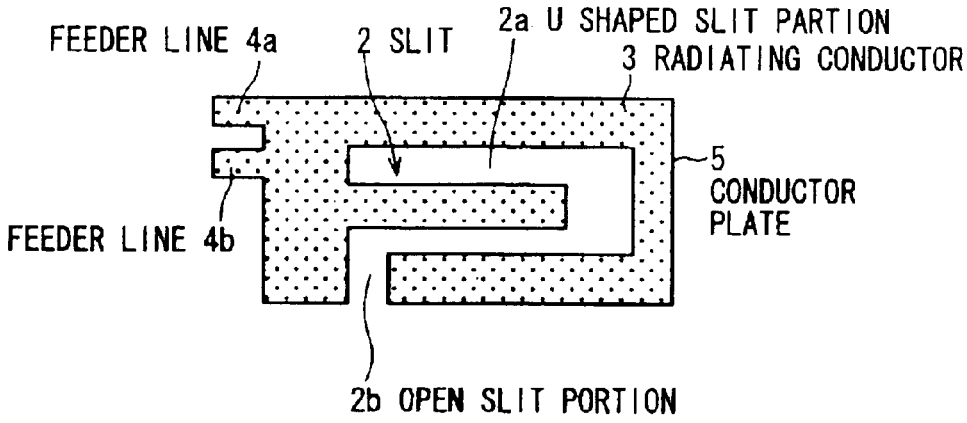
FIG. 9A and FIG. 9B are plane view showing other embodiments of the conductor plate.
Figure 9B:
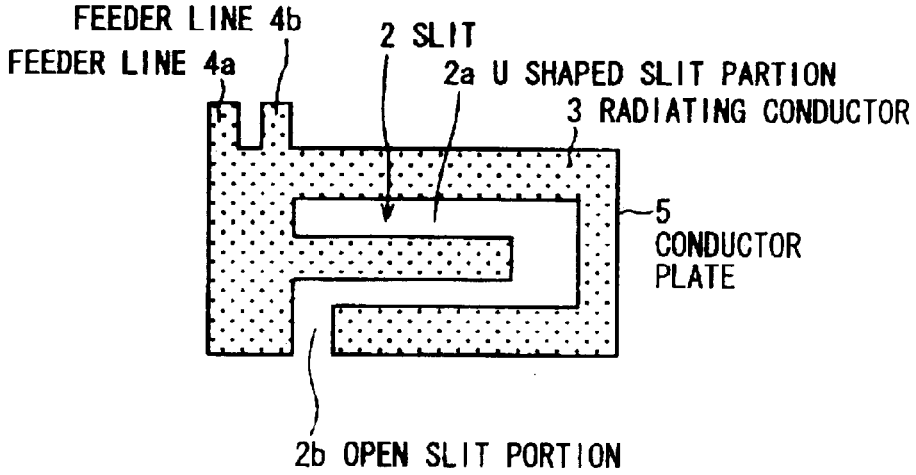

FIG. 9A and FIG. 9B are showing other embodiments of the conductor plate 5. In these embodiments, forming position of the feeder line 4*a*, 4*b* is different from the embodiment shown in FIG. 2A and FIG. 2B. FIG. 9A and FIG. 9B are showing states that the feeder line 4*a*, 4*b* is spread. In addition, the feeder line may be formed at portion of radiating conductor 3 positioning out side of the first slit portion $2_{a1}$ or out side of the third slit portion $2_{a3}$ in FIG. 2A.

Figure 10A:
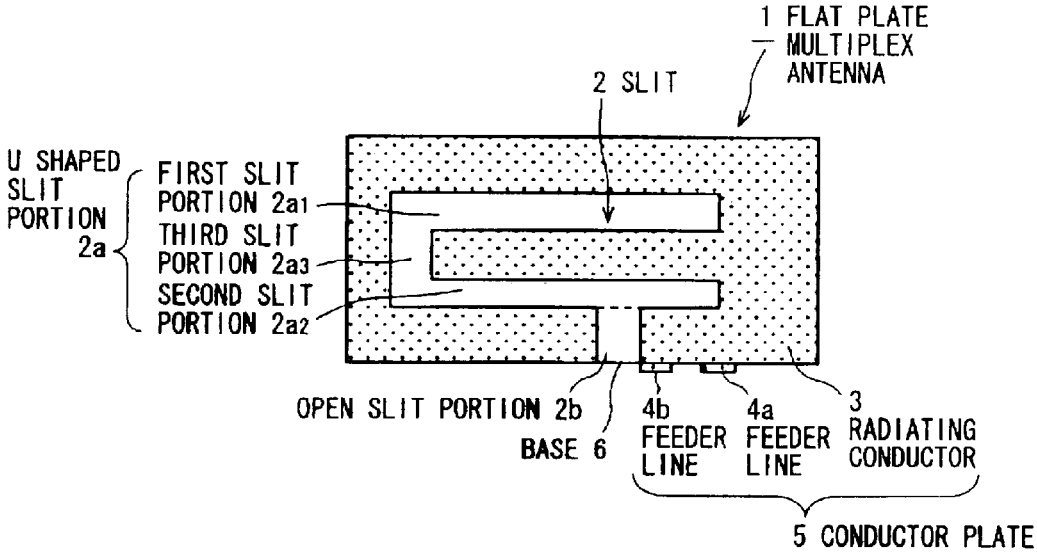
FIG. 10A is a plane view showing another embodiment of the flat-plate multiplex antenna of the present invention.
Figure 10B:
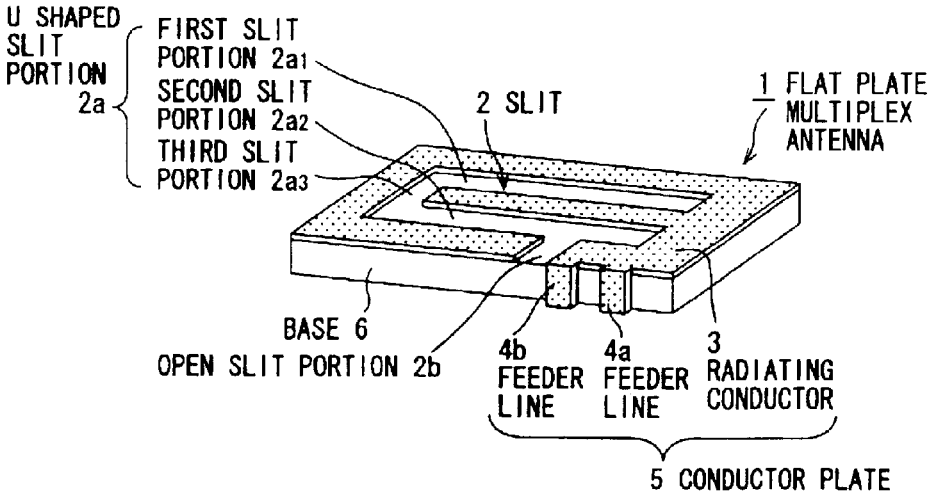
FIG. 10B is a perspective view showing another embodiment of the flat-plate multiplex antenna of the present invention.

FIG. 10A and FIG. 10B are showing another embodiment (second embodiment) of the flat-plate multiplex antenna of the present invention. The flat-plate multiplex antenna of this embodiment is different from the embodiment of FIG. 2A and FIG. 2B in that the position of the open slit portion 2*b* is shifted toward the third slit portion $2_{a3}$ side, and the feeder line 4*a*, 4*b* is provided on neighbor of the open slit portion 2*b*. In addition, size of each portion become different from the first embodiment in accordance with position of the open slit portion 2*b* and the feeder line 4*a*, 4*b*.

Figure 11A:
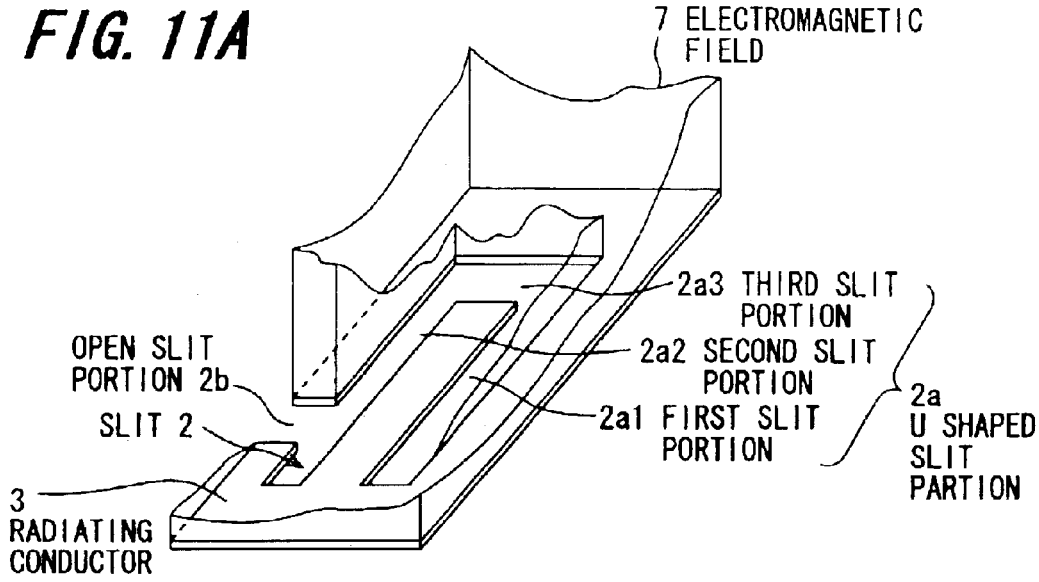
FIG. 11A is an explanatory view showing a simulation result of the first resonant frequency in another embodiment of the flat-plate multiplex antenna.
Figure 11B:
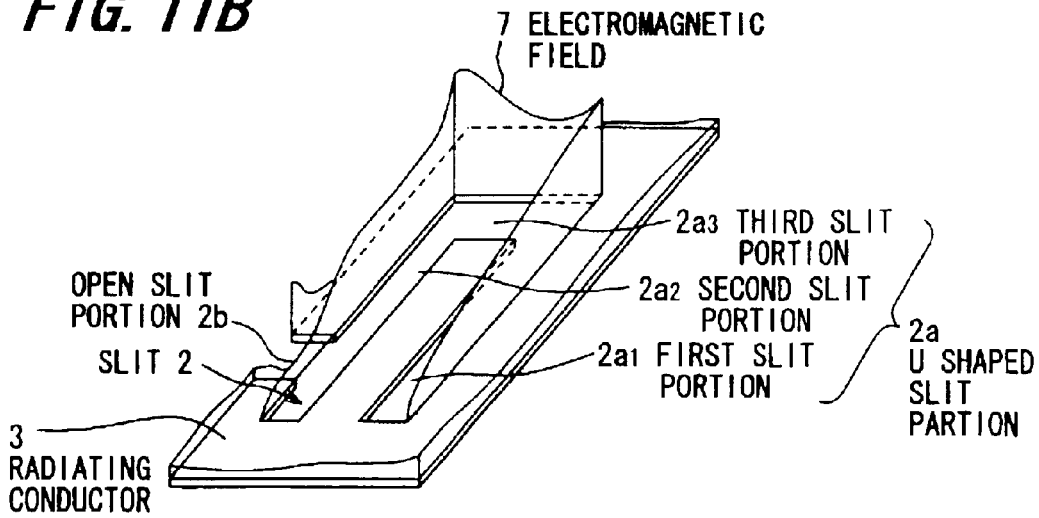
FIG. 11B is an explanatory view showing a simulation result of the second resonant frequency in the embodiment of the flat-plate multiplex antenna.

In FIG. 11A and FIG. 11B, simulation results of electromagnetic field in the second embodiment of the flat-plate multiplex antenna is shown. FIG. 11A is a simulation result of the first resonant frequency, and FIG. 11B is a simulation result of the second resonant frequency. The electromagnetic field 7 of the first resonant frequency is showing large value at outer edge of the radiating conductor 3 as shown in FIG. 11A, and the electromagnetic field 7 of the second resonant frequency is showing large value at outer edge of the slit 2 as shown in FIG. 11A. Therefore, the first resonant frequency is determined mainly by the length of outer edge of the radiating conductor 3, and the second resonant frequency is determined mainly by the length of outer edge of the slit 2. In addition, the first and second resonant frequency are varied with position of the feeder line 4*a*, 4*b*, dielectric constant of the base 6 and so on.

According to the second embodiment of the present invention, the first resonant frequency f1 is obtained to be 902 MHz and the second resonant frequency f2 is obtained to be 1828 MHz, band in both the first and second resonant frequency is widened, and can achieve small in size as well as the first embodiment.

FIG. 12A, FIG. 12B and FIG. 12C are showing an embodiment (third embodiment) of portable telephone as a portable terminal. The portable telephone 10 is provided with the printed circuit board 11, on the surface of the printed circuit board 11, the liquid crystal display 12, the keyboard 13, the circuit element 14C and so on are disposed, and behind the printed circuit board 11, the circuit element 14A constituting transmitting and receiving circuit, the shield cover 15A covering the circuit element 14A, the display 12, the circuit element 14B controlling the keyboard 13, the shield cover 15B covering the circuit element 14B, the battery 16, the flat-plate multiplex antenna 1 as shown in the first embodiment and electrically connected to a transmitting and receiving circuit and so on are disposed. These parts are covered by the case 17, and the battery cover 18 is provided behind the case 17.

The feeder line 4*a* for supplying power to the flat-plate multiplex antenna 1 is connected to an antenna signal pad on the printed circuit board 11, the feeder line 4*b* for grounding is connected to a ground pad on the printed circuit board 11, and the operating frequency corresponding to the either resonant frequency among two resonant frequency (finally determined by material, construction or so on of circumferences where the frat-plate multiplex antenna is involved) of the flat-plate multiplex antenna can be selected by a switch. The conductor plate 5 of the flat-plate multiplex antenna 1 is formed to be curved or bended according to mounting space within the portable telephone 10, and the base 6 is formed to be curved or bended according to the shape of the conductor plate 5. The size of each portion of the portable telephone 10 is determined to match the two operating frequency when the flat-plate multiplex antenna 1 is installed, and to obtain excellent exciting characteristic, by adding effects of dielectric constant of materials used for housing of the portable telephone 10 and conductor parts used for liquid crystal.

According to the above embodiment, since the thin and small size flat-plate multiplex antenna is installed in the portable telephone, thin and small size portable telephone can be obtained. Further, since the flat-plate multiplex antenna which operates at two frequency band, radio communication function of the portable telephone can be improved. In addition, the flat-plate multiplex antenna may be applied to other portable terminal such as mobile wireless device and a note type personal computer by forming in a shape according to installation space of such portable terminal.

The present invention is not limited to the above embodiments, but is applied to other embodiments. For example, even if the slit portion is that the length of either slit portion in a pair of parallel slit potion exceeds 1.2 times of the length of other slit portion ("J" shaped slit potion), band width can be widened by adjusting the slit width of the "J" shaped slit portion and the open slit portion corresponding to the band width.

As described above in detail, according to the present invention, since the width of each portion of the slit that is formed on the flat shaped radiating conductor with one end opened, a flat-plate multiplex antenna which is small size, wide band and possible to operate at least two frequency band can be obtained.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A flat-plate multiplex antenna having at least two resonant frequencies comprising:

a radiating conductor provided with a U shaped slit and open slit opening either end of said U shaped slit, and a feeder line which supplies power to said radiating conductor:

wherein low band side resonant frequency is adjusted mainly by length of outer edge of said radiating conductor, and high band side resonant frequency is adjusted mainly by length of outer edge of said U shaped slit.

2. A flat-plate multiplex antenna having at least two resonant frequencies according to claim 1, wherein said radiating conductor is provided on a base formed by a dielectric material.

3. A flat-plate multiplex antenna having at least two resonant frequencies according to claim 1, wherein said U shaped slit is provided with a pair of slit portion paralleling each other and a bottom slit portion between each of said pair slit portions.

4. A flat-plate multiplex antenna having at least two resonant frequencies according to claim 1, wherein length of either of said pair slit portions is 0.8–1.2 times of length of other of said pair slit portions.

5. A flat-plate multiplex antenna having at least two resonant frequencies according to claim 1, wherein width of either of said pair slit portions positioning at opposite side of said open slit is 1–2 times of width of other of said pair slit portions.

6. A flat-plate multiplex antenna having at least two resonant frequencies according to claim 1, wherein length of either of said pair slit portions is 0.8–1.2 times of length of other of said pair slit portions, and width of either of said pair slit portions positioning at opposite side of said open slit is 1–2 times of width of other of said pair slit portions.

7. A flat-plate multiplex antenna having at least two resonant frequencies according to claim 1, wherein width of portion of said radiating conductor positioning outside of either of said pair slit portions positioning at opposite side of said open slit is 1–2 times of width of portion of said radiating conductor outside of other of said pair slit portions.

8. A portable terminal in which a flat-plate multiplex antenna having at least two resonant frequencies is installed, wherein said flat-plate multiplex antenna comprising:

a radiating conductor provided with a U shaped slit and open slit opening either end of said U shaped slit, and a feeder line which supplies power to said radiating conductor;

wherein low band side resonant frequency is adjusted mainly by length of outer edge of said radiating conductor, and high band site resonant frequency is adjusted mainly by length of outer edge of said U shaped slit.

* * * * *